United States Patent [19]

Rowe, Jr.

[11] Patent Number: 4,697,043

[45] Date of Patent: Sep. 29, 1987

[54] PERCHLOROETHYLENE DIELECTRIC FLUID CONTAINING ALIPHATIC HYDROCARBONS

[75] Inventor: Edward A. Rowe, Jr., North Perry, Ohio

[73] Assignee: Occidental Electrochemical Corporation, Niagara Falls, N.Y.

[21] Appl. No.: 914,060

[22] Filed: Oct. 1, 1986

[51] Int. Cl.[4] ..... H01B 3/24

[52] U.S. Cl. ..... 174/17 LF; 174/25 C; 252/369; 252/570; 336/94

[58] Field of Search ..... 252/570, 364; 174/17 LF, 23 C, 25 C; 336/94; 361/317, 318

[56] References Cited

U.S. PATENT DOCUMENTS 1,966,901 7/1934 McMahon ..... 337/277
2,019,338 10/1935 Clark ..... 252/581
4,293,433 10/1981 Borror et al. ..... 336/94
4,312,794 1/1982 Pearce et al. ..... 252/581

OTHER PUBLICATIONS

Narasimha et al., "Isobaric Vapor-liquid Equilibrium of the Binary System 1,4-Dioxane-n-Heptane, Tetrachloroethylene-1,4-Dioxane and Tetrachloroethylene-n-Heptane," Indian Chem., Eng. 1978, 20(4), 46-8, (CA 93: 138599d).

*Primary Examiner*—Robert A. Wax
*Attorney, Agent, or Firm*—James F. Tao; William G. Gosz

[57] ABSTRACT

Dielectric fluid is prepared by combining perchloroethylene with an aliphatic hydrocarbon having 7-9 carbon atoms in the aliphatic chain. The resulting dielectric has improved freezing point and nonflammability characteristics.

13 Claims, No Drawings

PERCHLOROETHYLENE DIELECTRIC FLUID CONTAINING ALIPHATIC HYDROCARBONS

FIELD OF THE INVENTION

This invention relates generally to electrical devices containing dielectric fluid of the halogenated hydrocarbon type, and more particularly to a perchloroethylene based dielectric composition.

BACKGROUND OF THE INVENTION

Electrical devices such as power capacitors, transformers, condensers, cables, circuit breakers and the like often utilize a dielectric fluid as an insulating and cooling medium. For their insulating function, dielectric fluids must have high electrical resistance, high dielectric strength, and low conductivity. In the cooling function, the fluids should have characteristics such as good heat transfer and dissipation, low freezing point and high boiling point. The fluid must have excellent resistance to decomposition over long periods of time and under severe operational conditions. The dielectric fluid must not decompose to form electrically conductive or corrosive materials. Most importantly, satisfactory dielectric fluid will also be nonflammable.

Many materials have previously been employed as dielectric fluid, including mineral oils, esters of organic acids, castor oil, aromatic hydrocarbons and alkylates thereof, and the like. Few of these materials display all of the requisite characteristics for a satisfactory dielectric. The halogenated hydrocarbons such as trichloroethylene and perchloroethylene have also been suggested as dielectric fluids, particularly in combination with other chlorinated ethylenes and chlorinated aromatic hydrocarbons. Such combinations are disclosed in U.S. Pat. Nos. 1,966,901 and 2,019,338.

More recently, the highly chlorinated hydrocarbons such as polychlorinated biphenyls have been widely used. While these materials are functionally advantageous, they are objectionable because of their toxicity and persistence in the environment. Therefore, dielectric fluids which are nontoxic, nonflammable, environmentally acceptable, economical and resistant to degradation have been actively sought.

SUMMARY OF THE INVENTION

It has been discovered that a combination of perchloroethylene with a minor amount of an aliphatic hydrocarbon having 7–9 carbon atoms in the aliphatic chain results in a dielectric fluid having improved pour point and nonflammability characteristics. Dielectric and stability properties of the perchloroethylene are also enchanced by the combination.

DESCRIPTION OF THE INVENTION

When used in electrical devices such as transformers, a dielectric fluid must be able to operate effectively at elevated temperatures of 80°–90° C. for extended periods, and must be able to withstand shorter periods of temperatures up to 200° C. When used in devices for outdoor applications, the fluid is also exposed to temperatures well below freezing. Under these extreme conditions, any loss of dielectric fluid from the device or any change in the composition of the fluid by evaporation can have a deleterious effect on performance.

It has been known for some time that perchloroethylene (tetrachloroethylene) compositions can be effective dielectric fluids. Such compositions are described in U.S. Pat. Nos. 1,966,901; 2,019,338; 4,293,433 and 4,312,794. The disclosures of all of these patents are incorporated herein by reference. It has now been discovered that combination of perchloroethylene with $C_{7-9}$ aliphatic hydrocarbons provides an even more effective dielectric fluid.

Since perchloroethylene has a freezing point of −8° F. (−22° C.), it would be desirable to provide a composition with a lower freezing point. Combination of the perchloroethylene with minor amounts of hydrocarbon has a significant effect on the freezing point. The molal freezing point depression constant for perchloroethylene has been determined to be 9.9° C./m, where m equals moles of solute per kilogram of perchloroethylene. Such a depression of freezing point extends the effectiveness of the dielectric fluid in cold environments.

In addition to improved performance over an extended temperature range, the dielectric fluid of the invention retains the nonflammability characteristics required for severe use. This characteristic is particularly important in high temperature applications where loss of part of the dielectric composition by evaporation may change the relative concentration of the fluid components. Compositions of the invention meet ASTM E 681-79 standards for nonflammability under electrical arcing even after they have been 95% evaporated.

Aliphatic hydrocarbons suitable for use in the compositions of the invention may be selected from materials having 7–9 carbon atoms in the aliphatic chain. Exemplary materials include the saturated alkanes such as heptane, octane and nonane, as well as unsaturated alkenes such as heptene, octene and nonene. Satisfactory hydrocarbons may be used alone, or in various mixtures. The position isomers of the alkenes all appear to be useful, as the major variation between cis and trans forms is a wider range of freezing points. The $C_{7-9}$ alkanes and alkenes are well suited for use as freezing point depressants for perchloroethylene since the freezing points range from −51° C. for nonane down to −126° C. for cis-3-octene and −136.6° C. for trans-3-heptane.

A mixture of aliphatic hydrocarbons preferred for use in the invention is octene and nonene (nonylene). The boiling range of octene (121°–125° C.) is quite similar to the boiling point of perchloroethylene (121° C.), and therefore it behaves much like the perchloroethylene under high temperature conditions. The boiling point of nonene is slightly higher (147° C.), and it tends to remain in the liquid phase at elevated temperatures, thereby providing a more constant hydrocarbon concentration in the perchloroethylene during evaporation and condensation cycles. The ratio of octene to nonene in the mixture may range from 1:1 to 15:1, but a ratio of 11:1 to 14:1 is preferred.

In order to depress the freezing point of perchloroethylene to the desired level, it is only necessary to include a minor amount of aliphatic hydrocarbon, usually less than about 10% by weight. A hydrocarbon content of 6–10% by weight is preferred to obtain the best balance between depressed freezing point and nonflammability of the final composition.

An additional advantage of the blending of $C_{7-9}$ aliphatic hydrocarbons with the perchloroethylene dielectric lies in the ability of the hydrocarbon to act as an absorbent or sink for chlorine radicals which may form in the fluid. Such chlorine radicals may form by degradation of chlorinated hydrocarbon impurities present in the perchloroethylene. While perchloroethylene in a pure form is quite stable, certain impurities such as chlorinated ethanes may decompose when exposed to the conditions encountered in electrical devices, forming chlorine radicals which are corrosive and which impair the insulating characteristics of the fluid. The harmful effect of any such materials which may form is reduced by the sink effect of the aliphatic hydrocarbon.

The dielectric fluid may also include an antioxidant stabilizer which inhibits decomposition of the perchloroethylene and other halogenated components. These stabilizers are known in the art. Minor amounts of other additives may optionally be incorporated into the dielectric fluid. Such additives can include corrosion inhibitors, dyes, pour point regulants, viscosity index improvers, lubricating agents, other dielectric fluids and the like. The amount of such additives can be any quantity which does not adversely affect the results achieved by the present invention.

The electrical devices which can be improved by use of the disclosed dielectric fluid are well known. Such devices are designed to be insulated with a liquid, and are illustrated by power capacitors and transformers.

The invention is further described by the following examples.

EXAMPLE 1

Perchloroethylene (PCE) was blended with a mixture of octene (Shell Chemical) and nonene (Aldrich Chemicals) in various ratios of octene/nonene, and at different total aliphatic hydrocarbon contents. The blends were distilled according to ASTM Method D-1078 until only 5% of the original volume remained, and the first and last 5 ml cuts of the distillate were analyzed to determine the composition. Results are set forth in Table I. Hydrocarbon content of the dielectric distillate remained relatively constant.

TABLE I

| Sample | Hydrocarbon (wt. %) | Octene: Nonene | Octene/Nonene/PCE (wt. %) First 5 ml | Last 5 ml |
|---|---|---|---|---|
| 1 | 8 | 11.5:1 | 7.6/0.3/92.1 | 5.8/1.9/92.3 |
| 2 | 8 | 13:1 | 8.2/0.3/91.5 | 6.5/1.9/91.6 |
| 3 | 9 | 11.5:1 | 8.7/0.3/91.0 | 7.1/2.0/90.9 |
| 4 | 9 | 13:1 | 8.5/0.3/91.2 | 7.3/1.7/91.0 |

EXAMPLE 2

One hundred ml portions of the identical perchloroethylene blends described in Example 1 were evaporated until only 5 ml remained. Portions of the 5 ml samples were subjected to an electrical arc following the procedure described by ASTM E681-79 to measure the flammability of concentrated dielectric. All of the samples passed the ASTM test, as shown in Table II.

TABLE II

| Sample | Octene/ Nonene/PCE wt. % in 5 ml | Electrical 0.33 ml[1] | Arc-ASTM 0.5 ml[2] | E681-79 0.8 ml[3] |
|---|---|---|---|---|
| 1 | 5.9/4.0/90.1 | Pass | Pass | Pass |
| 2 | 6.3/3.5/90.2 | Pass | Pass | Pass |

TABLE II-continued

| Sample | Octene/ Nonene/PCE wt. % in 5 ml | Electrical 0.33 ml[1] | Arc-ASTM 0.5 ml[2] | E681-79 0.8 ml[3] |
|---|---|---|---|---|
| 3 | 6.8/4.5/88.7 | Pass | Pass | Pass |
| 4 | 6.7/4.4/88.9 | Pass | Pass | Pass |

[1] 0.33 ml calculated as within range of lower limit of flammability.
[2] 0.5 ml above lower limit of flammability.
[3] 0.8 ml approaches limit of equivalent vapor volume for test vessel.

EXAMPLE 3

The electrical properties of a typical dielectric fluid of the invention were determined in comparison with known fluids. A perchloroethylene composition containing 6% by weight of octene and 0.5% by weight of nonene was tested according to ASTM Method D-924 to determine dielectric constant and ASTM Method D-877 to determine dielectric strength, as were the known fluids. The results are set forth in Table III.

TABLE III

| Dielectric Fluid | Dielectric Constant | Dielectric Strength (KV) |
|---|---|---|
| Fluid of the Invention | 2.6 | 48 |
| Stabilized perchloroethylene | 2.4 | 40 |
| Fluorocarbon 113 | 2.4 | 37 |
| Askarel | 5.9 | 43 |
| Oil | 2.3 | 43 |
| Silicone | 2.5 | 35 |

What is claimed is:

1. A nonflammable dielectric fluid composition which comprises perchloroethylene and a minor amount of $C_{8-9}$ aliphatic hydrocarbon.

2. The composition of claim 1 wherein the aliphatic hydrocarbon content is less than 10% by weight.

3. The composition of claim 1 wherein the aliphatic hydrocarbon is selected from alkanes, alkenes or mixtures thereof.

4. The composition of claim 1 wherein the aliphatic hydrocarbon is selected from octene, nonene or mixtures thereof.

5. The composition of claim 1 wherein the aliphatic hydrocarbon is a mixture of octene and nonene.

6. The composition of claim 5 wherein the ratio of octene to nonene is in the range of 10–15:1.

7. The composition of claim 1 wherein the perchloroethylene contains an antioxidant stabilizer composition.

8. The composition of claim 1 wherein the perchloroethylene contains a dye.

9. In an electrical device containing a dielectric fluid, the improvement which comprises employing as the dielectric fluid a nonflammable composition containing perchloroethylene and a minor amount of $C_{7-9}$ aliphatic hydrocarbon.

10. The device of claim 9 wherein the dielectric fluid composition contains perchloroethylene and less than 10% by weight of an aliphatic hydrocarbon selected from alkanes, alkenes or mixtures thereof.

11. The device of claim 10 wherein the aliphatic hydrocarbon is a mixture of octene and nonene.

12. The device of claim 9 wherein the electrical device is a transformer.

13. An apparatus comprising a container, an electrical device therein, and a nonflammable dielectric fluid composition comprising perchloroethylene and a minor amount of $C_{7-9}$ aliphatic hydrocarbon surrrounding said device.

* * * * *